US007239824B2

(12) United States Patent
Fukuta

(10) Patent No.: US 7,239,824 B2
(45) Date of Patent: Jul. 3, 2007

(54) CARTRIDGE AND IMAGE FORMING APPARATUS

(75) Inventor: Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/232,923

(22) Filed: Sep. 23, 2005

(65) Prior Publication Data

US 2006/0072934 A1 Apr. 6, 2006

(30) Foreign Application Priority Data

Sep. 29, 2004 (JP) ..... 2004-285162

(51) Int. Cl.
*G03G 15/08* (2006.01)

(52) U.S. Cl. ..... 399/103

(58) Field of Classification Search ..... 399/103
See application file for complete search history.

(56) References Cited

U.S. PATENT DOCUMENTS 4,469,427 A * 9/1984 Kopp et al. ..... 399/103
4,615,608 A * 10/1986 Mizutani ..... 399/103
4,947,211 A * 8/1990 Ono et al. ..... 399/105
5,321,473 A 6/1994 Azami et al.
6,125,250 A * 9/2000 Kamio et al. ..... 399/98
6,356,723 B1 3/2002 Sat et al.
6,496,669 B2 12/2002 Sato et al.
2003/0118364 A1 6/2003 Kamimura

FOREIGN PATENT DOCUMENTS

EP 1168107 A2 1/2002
JP 60095560 A * 5/1985
JP 2001-60040 3/2001
JP 2003-195630 A 11/2003

OTHER PUBLICATIONS

EP Search Report dated Mar. 21, 2006, EP Appln. 05021171.

* cited by examiner

*Primary Examiner*—David M. Gray
*Assistant Examiner*—Bryan Ready
(74) *Attorney, Agent, or Firm*—Banner & Witcoff, Ltd.

(57) ABSTRACT

A toner receiving member, which is open upward, is provided at a position vertically below a lower end of a contact surface between a side seal member and a developing roller. The toner receiving member can receive and store toner which has leaked. In addition, when a developing cartridge is removed from a main body casing and then placed on a horizontal surface such as a desktop, a front wall, which serves as a bottom surface of the toner receiving member, faces upward. Toner collected in the toner receiving member may be prevented from leaking.

17 Claims, 12 Drawing Sheets

CARTRIDGE AND IMAGE FORMING APPARATUS

CROSS REFERENCE TO RELATED APPLICATION

This application claims priority from Japanese Patent Application No. 2004-285162, filed on Sep. 29, 2004, the entire subject matter of which is incorporated herein by reference.

TECHNICAL FIELD

Aspects of the invention relate to a cartridge and an image forming apparatus including the cartridge.

BACKGROUND

An electrophotographic image forming apparatus may be provided with a cartridge including a developing device. The cartridge is configured to be detachably attached to a body of the image forming apparatus. The cartridge includes a case storing toner as a developing agent and a developing roller rotatably mounted to the inside of an opening formed in the case. The developing roller is designed to form a visible image by transferring a thin toner layer formed on the developing roller to an electrostatic latent image formed on a photosensitive member drum. A toner leak prevention member, or a side seal, is attached to the case. The side seal contacts a circumferential surface of the developing roller at each end to prevent toner leakage. However, even when the side seal is mounted to the cartridge, toner may leak from both ends of the developing roller, causing a toner stain on the inside of the apparatus or on an operator's fingers or clothing during cartridge replacement.

Japanese Laid-Open Patent Publication No. 2001-60040 proposes a cartridge where a film prevention member is affixed to an end portion of a bottom wall of a cartridge case extending sideways at a lower portion of an opening to prevent toner that leaks on the bottom wall from flowing from the end portion to outside the cartridge case.

The above structure is applied to a cartridge that is attached to the apparatus body in a position where the opening is horizontally oriented. The position of the cartridge is not changed between when it is mounted to the apparatus body and placed on a horizontal surface such as a desktop. However, when there is a change in the position of the cartridge between when it is mounted to the apparatus body and placed on the horizontal surface, for example, when the cartridge is attached to the apparatus body in a position where the opening faces downward, the above structure may not be capable of preventing toner from leaking outside.

SUMMARY

Aspects of the invention provide a cartridge that may be capable of reliably preventing toner, if it leaks, from flowing outside the cartridge, and an image forming apparatus for use with the cartridge.

BRIEF DESCRIPTION OF THE DRAWINGS

Illustrative aspects of the invention will be described in detail with reference to the following figures wherein.

DETAILED DESCRIPTION

General Overview

Figure 1:
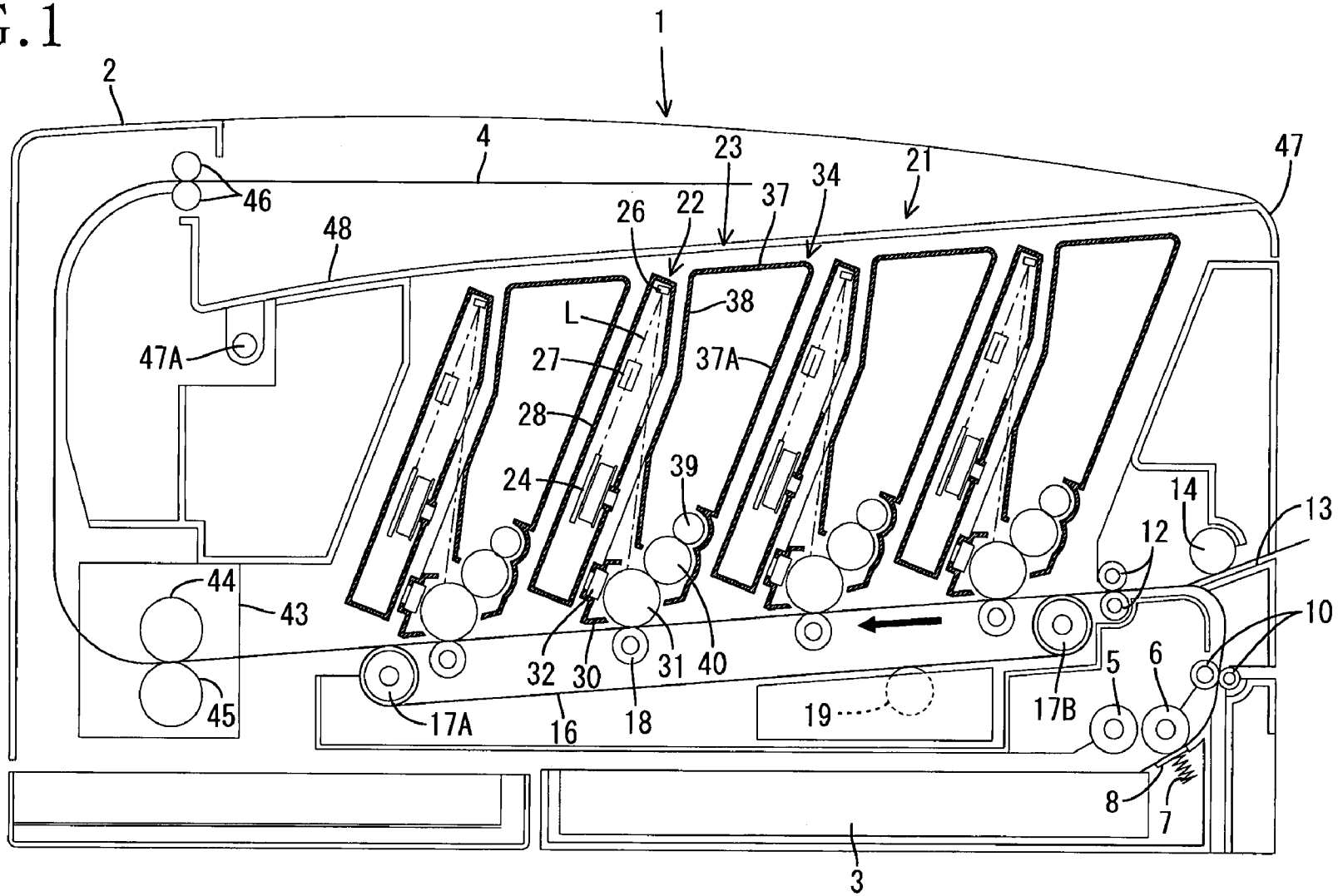
FIG. 1 is a side sectional view of general structure of a laser printer according to illustrative aspects of the invention.
Figure 2:
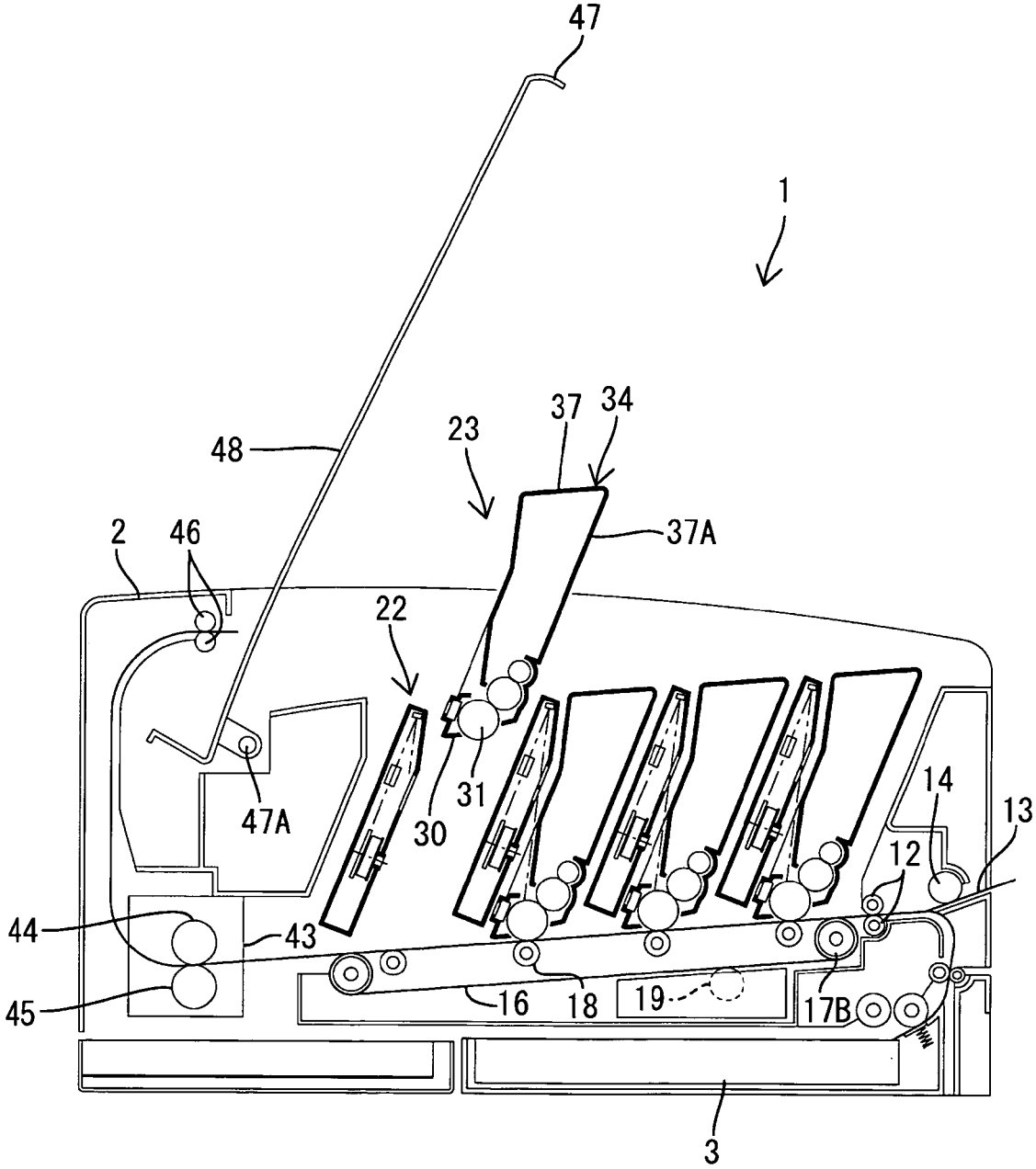
FIG. 2 is a side sectional view of the laser printer from which a process cartridge is removed according to illustrative aspects of the invention.

According to one aspect, a cartridge detachably attachable to a main body of an image forming apparatus may include: a case configured to store a developing agent and having an opening; a developing roller rotatably attached to the inside of the opening in the case and configured to form a visible image by transferring the developing agent, for example developing agent formed in a thin layer on a surface of the developing roller, to an electrostatic latent image; and a side seal member provided at each end of the case, the side seal member having a contact surface that makes contact with a surface of the developing roller. The orientation of the cartridge may vary depending on whether it is attached to the main body of the image forming apparatus or whether the cartridge is placed on a horizontal surface. The case may be provided with a developing agent receiving member opening below the contact surface in an upward direction.

According to another aspect, the case includes a lower seal provided below the opening and configured to make contact with the surface of the developing roller along an axial direction thereof, for example when the cartridge is attached to the main body of the image forming apparatus.

According to a further aspect, the developing agent in the developing agent receiving member may be prevented from leaking outside of the case when the cartridge is placed on a horizontal surface.

According to a still further aspect, the developing agent receiving member may be configured to prevent the developing agent from leaking when the cartridge is placed on a horizontal surface.

According to an aspect, the developing agent receiving member may have a bottom surface with a rising gradient toward an opening side when the cartridge is placed on the horizontal surface.

According to an aspect, the developing agent receiving member may be shaped like a box opening upward when the cartridge is attached to the main body of the image forming apparatus.

According to an aspect, the developing agent receiving member may be disposed such that an upper end of a sidewall positioned below the developing roller is placed above a lower end of the developing roller when the cartridge is attached to the main body of the image forming apparatus.

According to an aspect, when the cartridge is attached to the main body of the image forming apparatus, the developing agent receiving member is provided so as to be open upward between a position below the lower portion of the contact surface and a position below a lower portion of the side seal member.

According to an aspect, the developing agent receiving member includes a sponge material configured to absorb the developing agent.

According to an aspect, an image formation belt that holds the visible image or conveys a recording medium may be disposed below the developing roller, and wherein the lower end of the developing agent receiving member is positioned above the image formation belt.

According to an aspect, a photosensitive drum configured to hold the visible image may be disposed below the developing roller, and the developing agent receiving member may be disposed above an upper portion of the photosensitive drum.

According to an aspect, the image forming apparatus may include cartridges, each cartridge having a different color developing agent. The cartridges may be arranged along the image formation belt.

Illustrative Aspects

Some aspects of the invention will be described in detail with reference to FIGS. 1 through 12.

FIG. 1 is a sectional view showing general structure of a laser printer 1 as an image forming apparatus according to some aspects. The laser printer 1 is a direct-tandem color laser printer having four photosensitive drums 31 corresponding to each color of black, cyan, magenta, and yellow. In the following description, a right side in FIG. 1 is referred to as a front side.

The laser printer 1 includes a sheet supply tray 3 at a lower portion in a main body casing 2. The sheet supply tray 3 is detachably attached to the main body casing 2 from the front side. The sheet supply tray 3 is configured to supply a stack of sheets 4 therein for image formation. A presser plate (not shown) is provided at a bottom portion of the sheet supply tray 3 and is configured to raise the leading end of the sheets 4. A pickup roller 5, a sheet feed roller 6, which are arranged in tandem, and a separation pad 8, which makes contact with the sheet feed roller 6 in response to an urging force of a spring 7, are provided above the front side of the sheet supply tray 3. A pair of paper-dust removing rollers 10 is provided obliquely upward and frontward from the sheet feed roller 6.

An uppermost sheet 4 in the sheet supply tray 3 is pressed against the pickup roller 5 by the urging force of the presser plate, and the uppermost sheet 4 is conveyed between the sheet supply roller 6 and the separation pad 8 when the pickup roller 5 rotates. When the sheet 4 is sandwiched between the sheet supply roller 6 and the separation pad 8 by the rotation of the sheet supply roller 6, it is separated from the stack and fed one by one, obliquely upward and frontward. After paper dust is removed from the sheet 4 by the pair of paper dust removing rollers 10, the sheet 4 is conveyed to a pair of register rollers 12 disposed obliquely upward and rearward from the paper-dust removing rollers 10. A sheet supply slot 13 for supplying a sheet 4 manually is provided at the front face of the main body casing 2. The sheet 4 supplied from the sheet supply slot 13 is conveyed to the register rollers 12 by a sheet supply roller 14 for manual feeding. At the register rollers 12, skewing of the sheet 4 is accounted for and then the sheet 4 is conveyed onto a conveyor belt 16.

The conveyor belt 16 for image formation extends between a pair of belt support rollers 17A, 17B, which are spaced apart from each other in a position where the belt 16 inclines downward toward the rear. The conveyor belt 16 revolves when the rear belt support roller 17A is rotated. Inside the conveyor belt 16, four transfer rollers 18 are aligned with each other at a specified distance away so as to face a corresponding one of the photosensitive drums 31 provided in each process cartridge 23, which will be described later. The conveyor belt 16 is sandwiched between each photosensitive drum 31 and the corresponding one of the transfer rollers 18. Under the conveyor belt 16, a cleaning roller 19 for cleaning toner remaining on the conveyor belt 16 is provided. The sheet 4 conveyed from the register rollers 12 is electrostatically attracted to the upper surface of the conveyor belt 16, and is conveyed rearward along with the movement of the conveyor belt 16.

An image forming part 21 for forming an image on a sheet 4 to be conveyed on the conveyor belt 16 is provided above the conveyor belt 16. The image forming part 21 includes four scanner units 22 and four process cartridges 23 corresponding to each color of magenta, yellow, cyan, and black. These scanner units 22 and process cartridges 23 are alternately arranged in tandem with each other. Each scanner unit 22 includes a polygon mirror 24, a reflecting mirror 26, and an fθ lens 27, which are all stored in a scanner case 28. The polygon mirror 24 reflects a laser beam L emitted from a laser diode (not shown) so as to sequentially change the direction of the beam along a specified surface. The reflecting mirror 26 reflects the laser beam L reflected by the polygon mirror 24 on the photosensitive drum 31 of the process cartridge 23. The fθ lens 27 is provided in an optical path of the laser beam L. Each scanner case 28 is formed in a plate-like shape and attached in a position in which its upper end side is inclined toward the front of the case.

Figure 3:
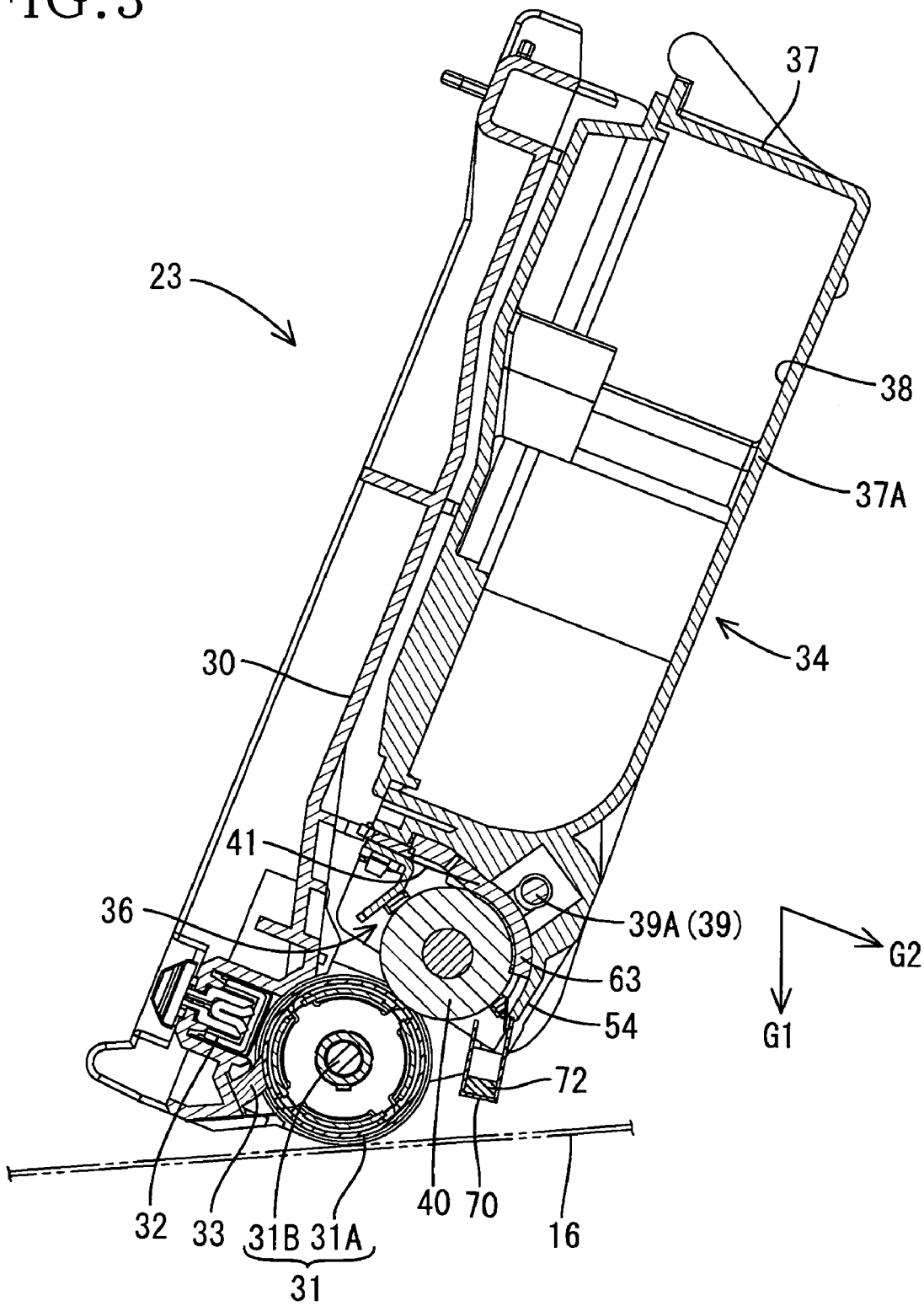
FIG. 3 is a side sectional view of the process cartridge according to illustrative aspects of the invention.
Figure 4:
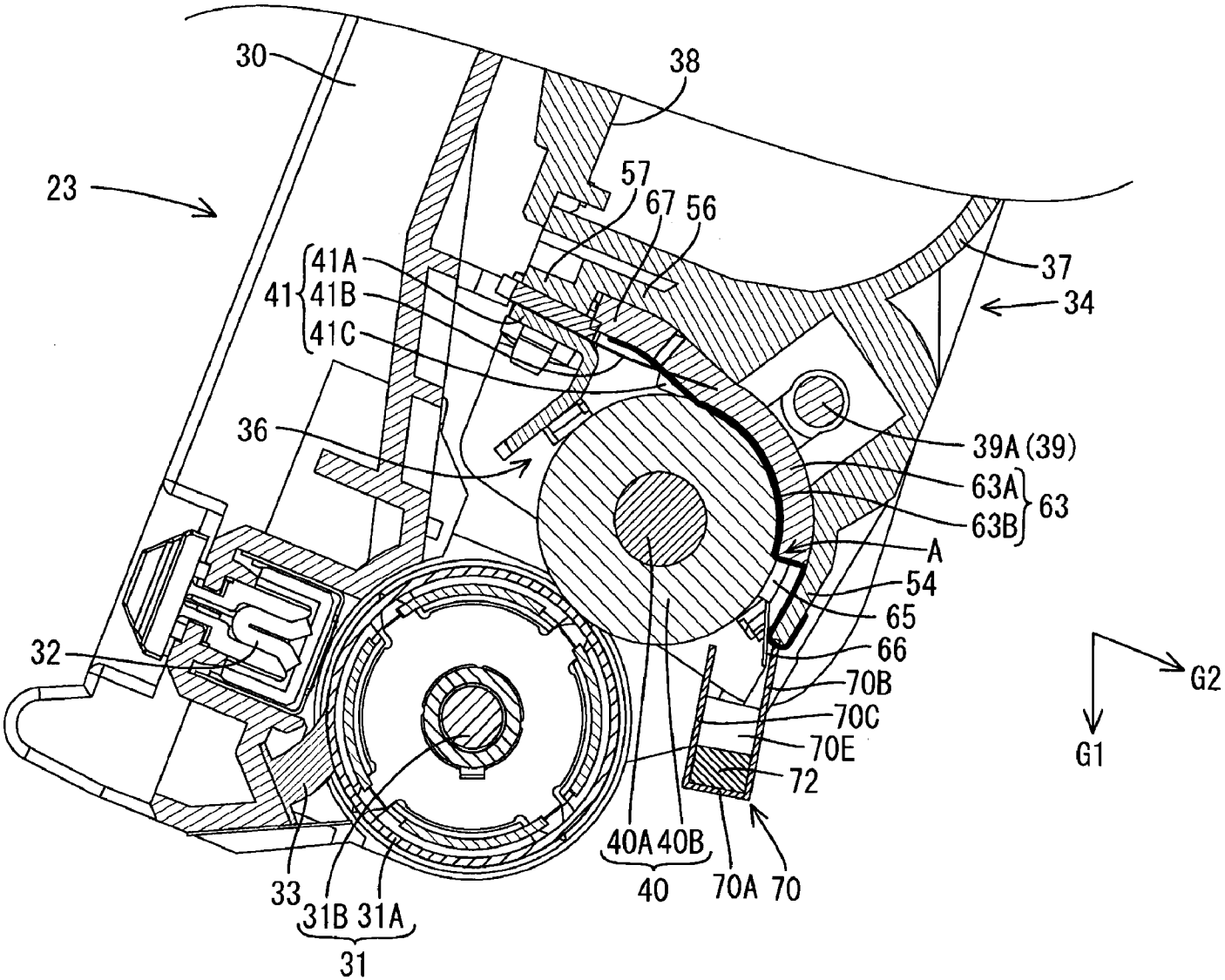
FIG. 4 is an enlarged side sectional view of the process cartridge according to illustrative aspects of the invention.

FIG. 3 is a side sectional view of the process cartridge 23, and FIG. 4 is a partially enlarged view of FIG. 3. In both figures, an arrow line G1 indicates a direction relative to gravity (downward) when the process cartridge 23 is mounted in the main body casing 2, and the right side in both figures is referred to as the front. In the following description of the process cartridge 23 (or a developing cartridge 34, which will be described later), directions are indicated with reference to the position of the process cartridge 23 mounted in the main body casing 2, unless otherwise specified.

The process cartridge 23 includes the photosensitive drum 31, a scorotron charger 32, a cleaning brush 33 in a lower portion of a cartridge frame 30, and a developing cartridge 34 in an upper portion of the cartridge frame 30.

The photosensitive drum 31 is formed in a cylindrical shape, and includes a drum body 31A and a drum shaft 31B. The drum body 31A is formed such that its outermost layer is a positively charged photosensitive layer made of polycarbonate or the like. The drum shaft 31B may be made of metal and extends along a longitudinal direction of the drum body 31A. The photosensitive drum 31 is provided rotatably on the drum shaft 31B supported by the cartridge frame 30. The photosensitive drum 31 is rotatably driven by input of power from a motor (not shown).

The scorotron charger 32 is disposed obliquely upward behind the photosensitive drum 31 facing the photosensitive drum 31 at a specified distance away so as not to contact the photosensitive drum 31. The scorotron charger 32 generates a corona discharge from a charging wire made of tungsten or the like, to charge the surface of the photosensitive drum 31 positively and uniformly.

The cleaning brush 33 is disposed to contact the rear of the photosensitive drum 31.

The developing cartridge 34 is detachably attached to the cartridge frame 30. The developing cartridge 34 includes a box-shaped case 37 having an opening 36 at a lower portion of the case 37. The case 37 has a flat face 37A at its front. The developing cartridge 34 is mounted in the main body casing 2 so that the flat face 37A is inclined with its upper side facing the front. A toner chamber 38, in which toner of each color is stored, is formed at an upper portion of the case 37. An agitator (not shown) is provided in the toner chamber 38. As the agitator is rotatably driven by an input of power from a motor (not shown), toner stored inside is agitated. A supply roller 39, a developing roller 40 and a layer thickness regulating blade 41 are provided at a lower portion of the toner chamber 38.

The supply roller 39 is rotatably supported by the case 37, and is formed by covering a metal roller shaft 39A with a roller body 39B (FIG. 6) made of a conductive foaming material. The supply roller 39 is rotatably driven by the input of power from a motor (not shown).

The developing roller 40 is rotatably supported by the case 37 such that it is pressed into contact with the supply roller 39 obliquely from below behind the supply roller 39. The developing roller 40 is pressed into contact with the photosensitive drum 31 with the developing cartridge 34 mounted in the cartridge frame 30. The developing roller 40 is formed by covering a metal roller shaft 40A with a roller body 40B made of a conductive rubber material. The developing roller 40 is rotatably driven by the input of power from a motor (not shown).

The layer-thickness regulating blade 41 includes a support portion 41A formed of iron or stainless steel, a thin leaf spring 41B attached to the support portion 41A and formed of phosphor bronze or stainless steel, and a pressing portion 41C attached to an end of the leaf spring 41B and formed of insulative silicone rubber. The layer-thickness regulating blade 41 is supported by the case 37 above the developing roller 40, and the pressing portion 41C is pressed against the developing roller 40 by an elastic force of the leaf spring 41B.

Toner discharged from the toner chamber 38 is supplied to the developing roller 40 by rotation of the supply roller 39, and is positively charged by friction between the supply roller 39 and the developing roller 40. The toner supplied to the developing roller 40 goes in between the pressing portion 41C of the layer-thickness regulating blade 41 and the developing roller 40 along with a rotation of the developing roller 40 and is carried on the developing roller 40 as a thin layer of a predetermined thickness.

The surface of the photosensitive drum 31 is uniformly and positively charged by the scorotron charger 32 along with the rotation of the photosensitive drum 31. Then, it is irradiated with the laser beam L emitted from the scanner unit 22 at high speed, so that an electrostatic latent image corresponding to an image to be formed on the sheet 4 is formed.

When the developing roller 40 is rotated, the toner that is carried on the developing roller 40 and positively charged faces the photosensitive drum 31 and is supplied to the electrostatic latent image formed on the surface of the photosensitive drum 31. Thus, the electrostatic latent image becomes visible, and a toner image formed by reversal development is carried on the surface of the photosensitive drum 31.

As the sheet 4, which is conveyed by the conveyor belt 16, passes through a transfer position between the photosensitive drum 31 and the transfer roller 18, a transfer bias is applied to the transfer roller 18, and the toner image carried on the surface of the photosensitive drum 31 is transferred onto the sheet 4. The sheet 4 on which the toner image has been transferred is conveyed to the fixing unit 43.

The fixing unit 43 is disposed behind the conveyor belt 16 in the main body casing 2 as shown in FIG. 1. The fixing unit 43 has a heat roller 44 and a pressure roller 45 which are placed opposite to each other. The fixing unit 43 fixes the toner image transferred on the sheet 4 by heat. The sheet 4 is turned around in a U-turn and conveyed to ejection rollers 46, which are provided at an upper portion in the main body casing 2. On the top of the main body casing 2, a cover 47 openable and closable at a hinged portion 47A is provided. The top of the cover 47 serves as an output tray 48 where the sheet 4 after image formation is ejected by the ejection rollers 46 and placed. When the cover 47 is opened, the process cartridge 23 in the main body casing 2 can be replaced.

Figure 5:
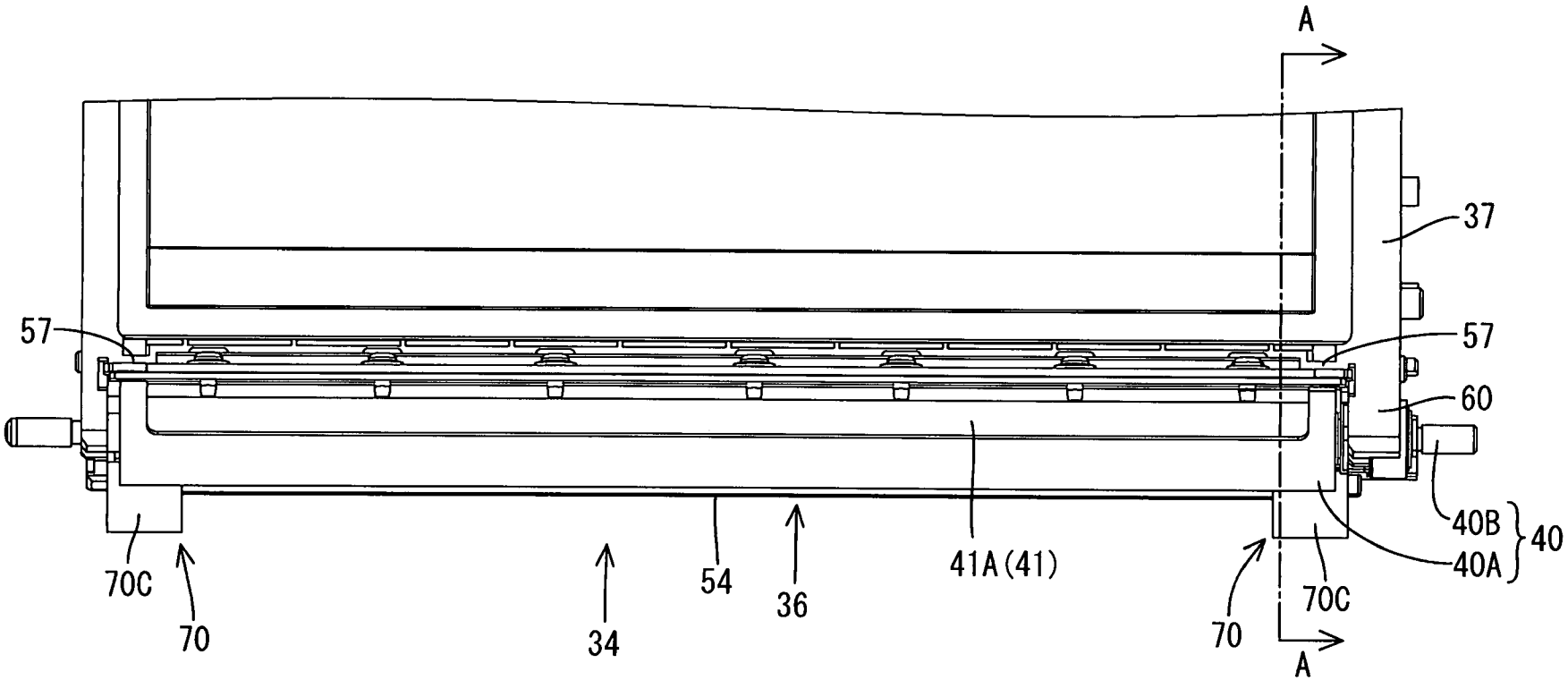
FIG. 5 is a view of a developing cartridge viewed diagonally from below according to illustrative aspects of the invention.
Figure 6:
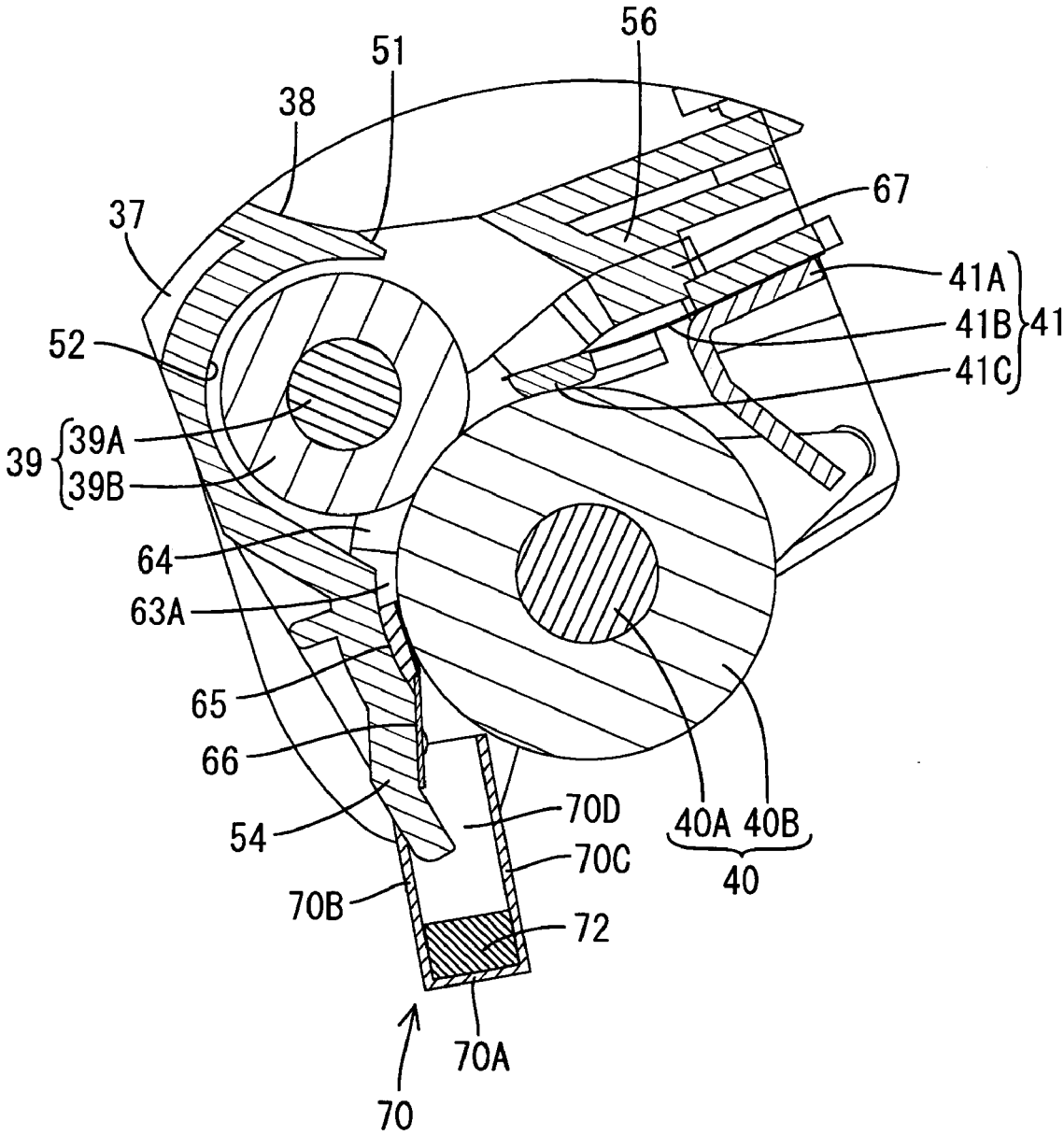
FIG. 6 is a sectional view taken along the line A—A of FIG. 5 according to illustrative aspects of the invention.

A sealing structure in the developing cartridge 34 will be described with reference to drawings in conjunction with an attachment procedure of each component. The following description will be made based on a lower right edge portion of the developing cartridge 34. The lower right edge portion of the developing cartridge 34 is structured substantially symmetrically to the lower left edge portion. FIG. 5 is a view of the developing cartridge 34 viewed from below. FIG. 6 is a sectional view taken along the line A—A of FIG. 5. FIGS. 7 through 10 are perspective views showing that each component is attached to the lower right edge portion of the developing cartridge 34. FIGS. 11 and 12 are rear elevations showing that each component is attached to the lower right edge portion of the developing cartridge 34.

Figure 7A:
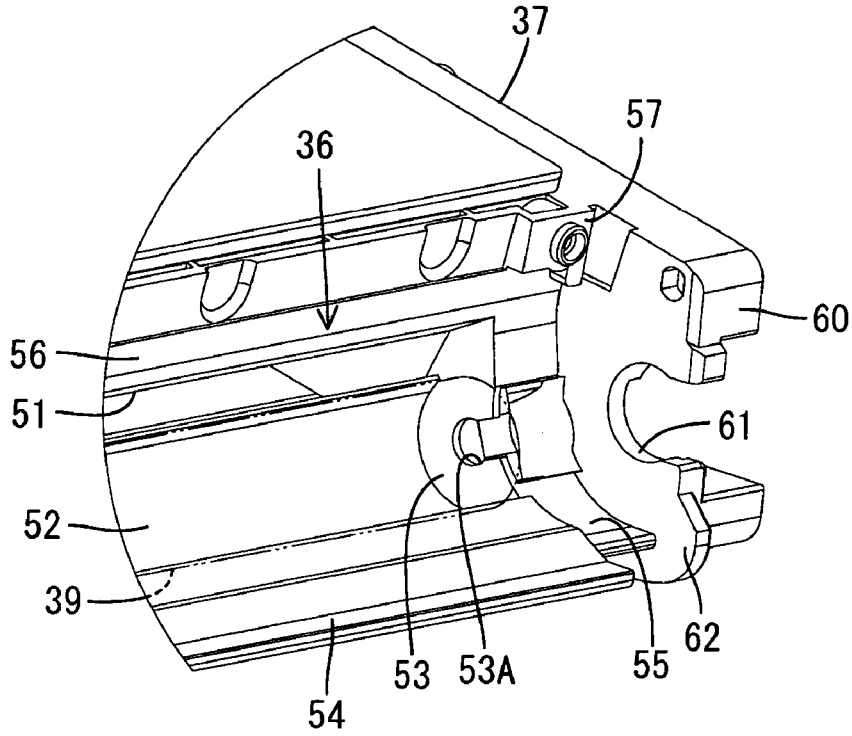
FIG. 7A is a perspective view showing a bottom right-side portion of a case before components are attached according to illustrative aspects of the invention.

FIG. 7A shows a lower right edge portion of the case 37 before sealing members are attached. A communication opening 51 that communicates with the toner chamber 38 is provided at the back of the opening 36 of the case 37. A supply roller storing portion 52, where a part of the supply roller 39 is stored, is formed on a front wall surface, which is provided outside from (e.g., below) the communication opening 51 (refer to FIG. 6 also). A storing portion sidewall 53 is provided on each end of the supply roller storing portion 52. The storing portion sidewall 53 is formed with a bearing hole 53A that is capable of receiving the roller shaft 39A of the supply roller 39 and is open diagonally downward and to the rear. A lower opening edge portion 54, which is parallel to a longitudinal direction of the opening 36, is formed extending diagonally downward from a bottom edge of the sidewall surface defining the supply roller storing portion 52. The end surface of the storing portion sidewall 53 and the side edge of the lower opening edge portion 54 are substantially aligned with each other, and a side seal attaching portion 55 is not aligned thereto. The side seal attaching portion 55 is curved substantially in an arc shape cross section. The lower edge portion of the side seal attaching portion 55 is recessed more than the lower opening edge portion 54, and the lower opening edge portion 54 extends downward more than the lower edge portion of the side seal attaching portion 55. The upper end portion of the side seal attaching portion 55 is continuous with an end portion of an upper opening edge portion 56 along the longitudinal direction of the opening 36. Above the upper end portion of the side seal attaching portion 55, a blade attaching portion 57 for attaching the layer thickness regulating blade 41 is formed.

A sidewall portion 60 is provided extending downwardly further outside than the side seal attaching portion 55, that is, at each side of the case 37. The sidewall portion 60 is formed with a bearing hole 61 capable of receiving each end of the roller shaft 40A of the developing roller 40. The developing roller 40 is laid between the sidewall portions 60 by inserting both ends of the roller shaft 41 into each bearing hole 61, so that the roller body 40B occupies a major part of the opening 36. With this structure, areas to be sealed are defined between the roller body 40B of the developing roller 40 and the lower opening edge portion 54, between the roller body 40B and the upper opening edge portion 56, and between the roller body 40B and the side seal attaching portion 55 at each end. An extension portion 62 capable of receiving a toner receiving member 70 is formed at a lower edge portion of the sidewall portion 60.

Before attachment of each component, the end portion of the roller shaft 39A of the supply roller 39 is inserted into the bearing hole 53A. Thus, the supply roller 39 is mounted in the supply roller storing portion 52 as indicated by a double dotted line in FIG. 7A.

Figure 7B:
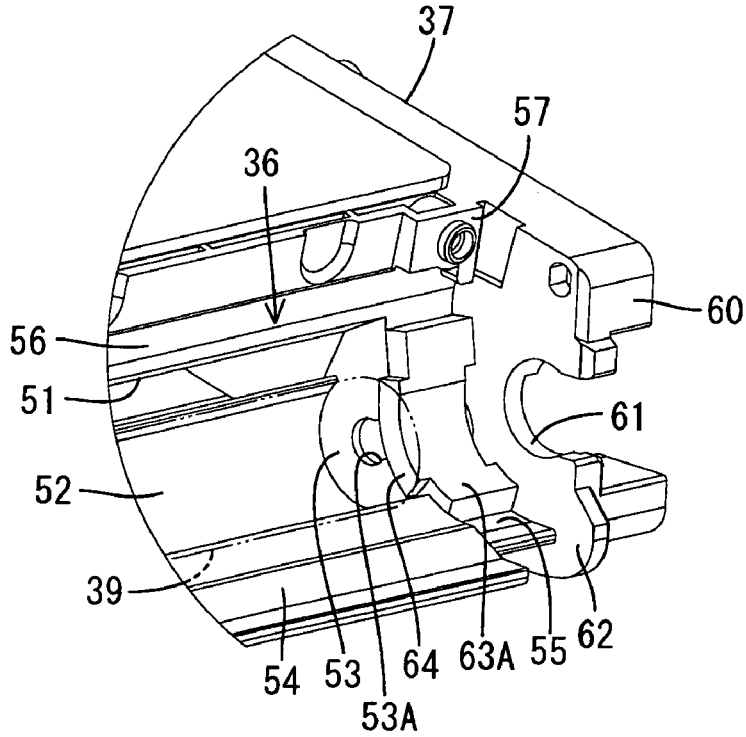
FIG. 7B is a perspective view showing the bottom right-side portion of the case where a side seal is affixed according to illustrative aspects of the invention.

As shown in FIG. 7B, a side seal 63A, as a base material of a side seal member 63, is attached to the side seal attaching portion 55 with double-faced adhesive tape, to prevent toner leakage from both end portions of the developing roller 40. The side seal 63A is made of a urethane sponge having a relatively high rigidity and a certain thickness to generate a specified pressing force when compressed by the developing roller 40 mounted in position. This structure allows a Teflon® felt 63B, which is to be placed on the uppermost layer of the side seal 63A, to press against the developing roller 40 with a specified pressing force. In addition, the side seal 63A is formed with a projecting portion 64 that projects toward the supply roller storing portion 52 at its side surface. The projecting portion 64 makes sliding contact with the side edge surface of the supply roller 39, and thus toner leakage between the supply roller 39 and the side seal 63A can be prevented.

Figure 8A:
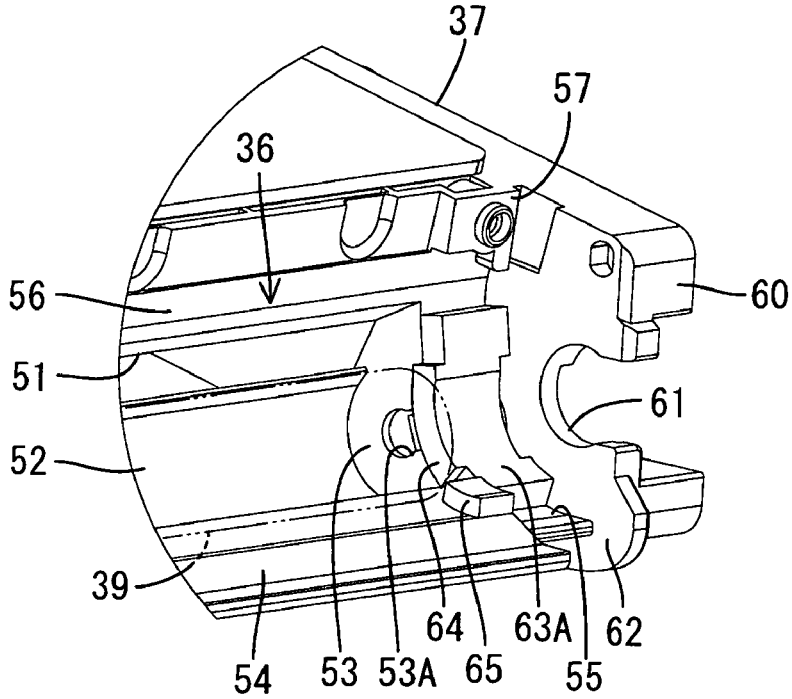
FIG. 8A is a perspective view showing the bottom right-side portion of the case where a lower side seal is affixed according to illustrative aspects of the invention.

As shown in FIG. 8A, the lower side seal 65 is attached to an end portion on the lower opening end portion 54 with double-faced adhesive tape to prevent toner leakage in the boundary between the lower opening edge portion 54 and the side seal attaching portion 55 and toner leakage from a gap between a free end of the lower seal 66 and the lower opening edge portion 54. The lower side seal 65 is attached by pressing a side against a lower end portion of the side of the side seal 63A, so as to keep both seals 63A and 65 in contact with each other.

Figure 8B:
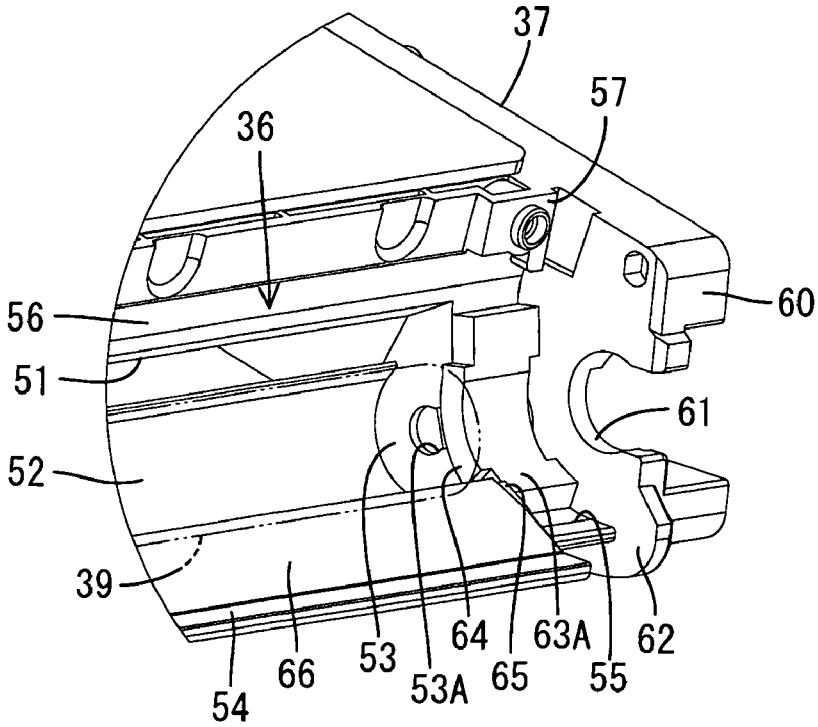
FIG. 8B is a perspective view showing the bottom right-side portion of the case where a lower seal is affixed according to illustrative aspects of the invention.

As shown in FIG. 8B, the lower seal 66 is attached along the longitudinal direction of the lower opening end portion 54 to prevent toner leakage from the bottom end portion of the developing roller 40. The lower seal 66 is a PET sheet or a urethane rubber film. The lower seal 66 is attached to the lower opening edge portion 54 at its lower end and to the top of the lower side seal 65 at its each upper end, with double-faced adhesive tape. The lower seal 66 is elevated from the lower opening edge portion 54 at its upper end side that is the free end. The free end of the lower seal 66 is supposed to make sliding contact with a circumferential surface of the developing roller 40 along its axial direction.

Figure 9A:
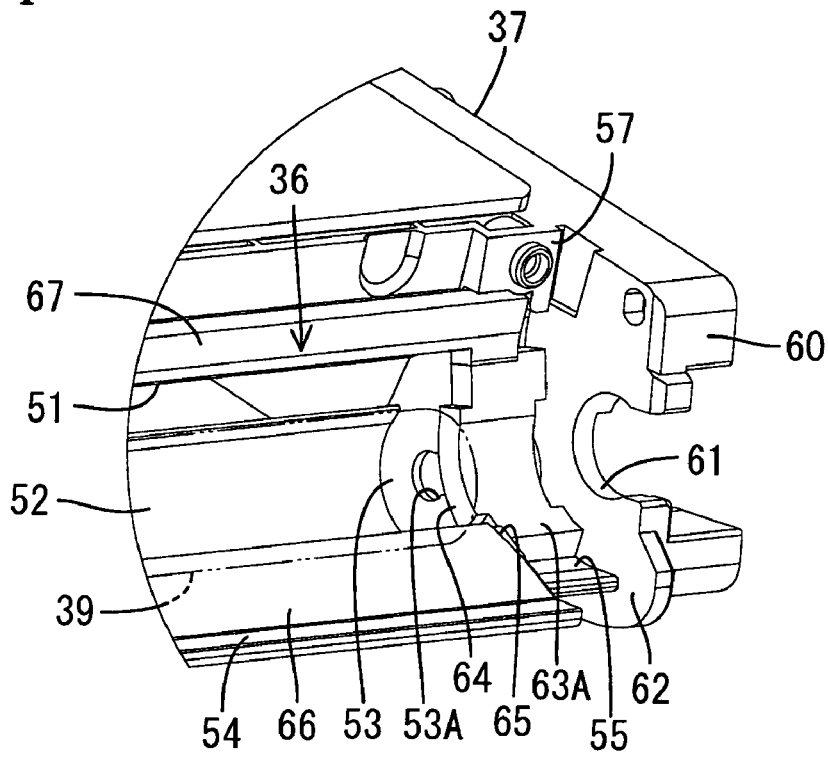
FIG. 9A is a perspective view showing the bottom right-side portion of the case where an upper seal is affixed according to illustrative aspects of the invention.

As shown in FIG. 9A, an upper seal 67 is attached in alignment with the upper opening edge portion 56 to prevent toner leakage from the gap between the support portion 41A of the layer thickness regulating blade 41 and the upper opening edge portion 56. The upper seal 67 is formed of a urethane sponge. The upper seal 67 is pressed against the upper edge of the side seal 63A at each end to keep both seals 67 and 63A in contact with each other.

Figure 9B:
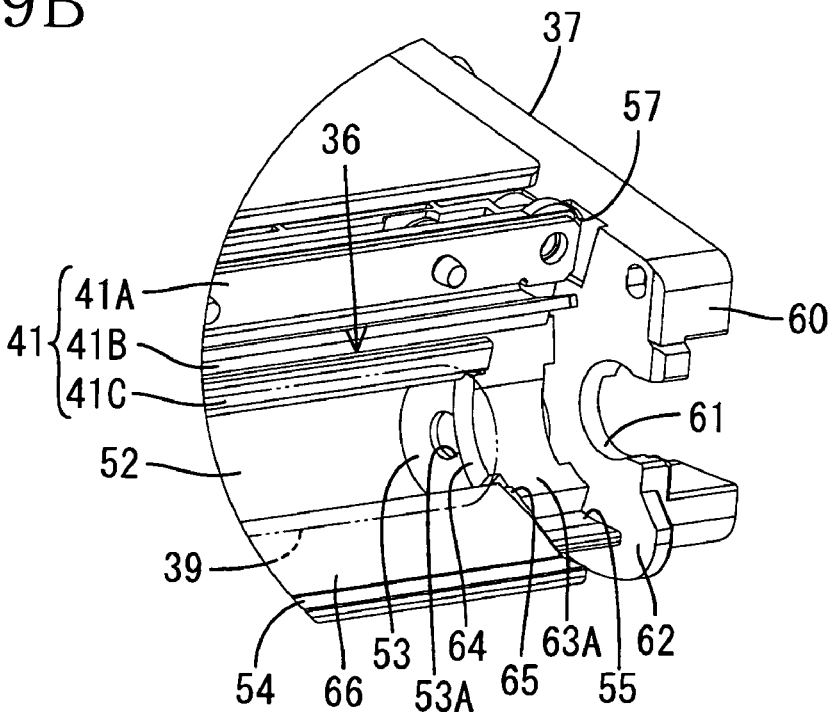
FIG. 9B is a perspective view showing the bottom right-side portion of the case where a layer-thickness regulating blade is attached according to illustrative aspects of the invention.

As shown in FIG. 9B, the layer thickness regulating blade 41 is attached, in parallel with a direction where the roller shaft 40A extends, in an upper portion of the opening 36 by fixing both end portions of the layer thickness regulating blade 41 to each blade attaching portion 57.

Figure 10:
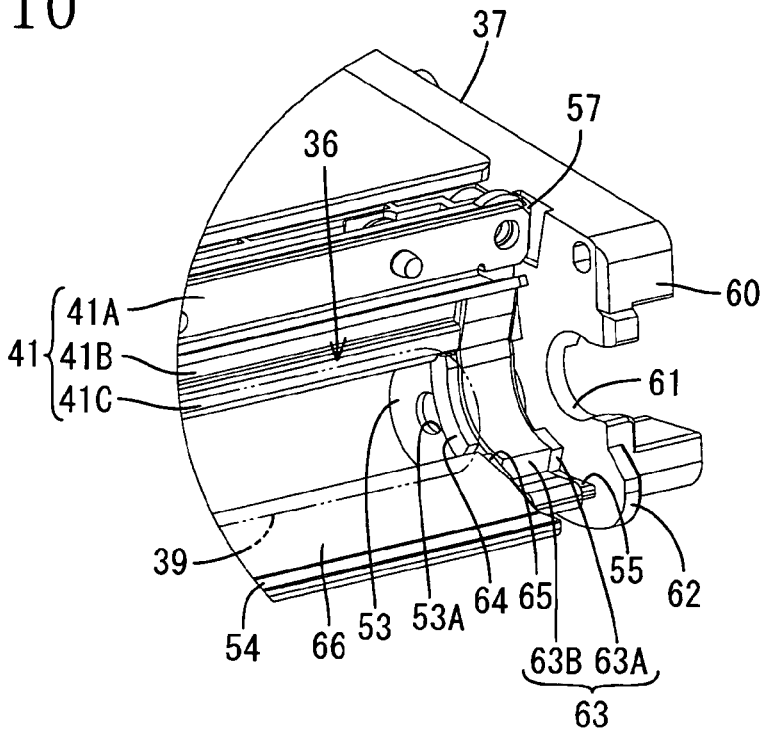
FIG. 10 is a perspective view showing the bottom right-side portion of the case where a Teflon® felt (Teflon® a registered trademark of DuPont) is attached according to illustrative aspects of the invention.
Figure 11:
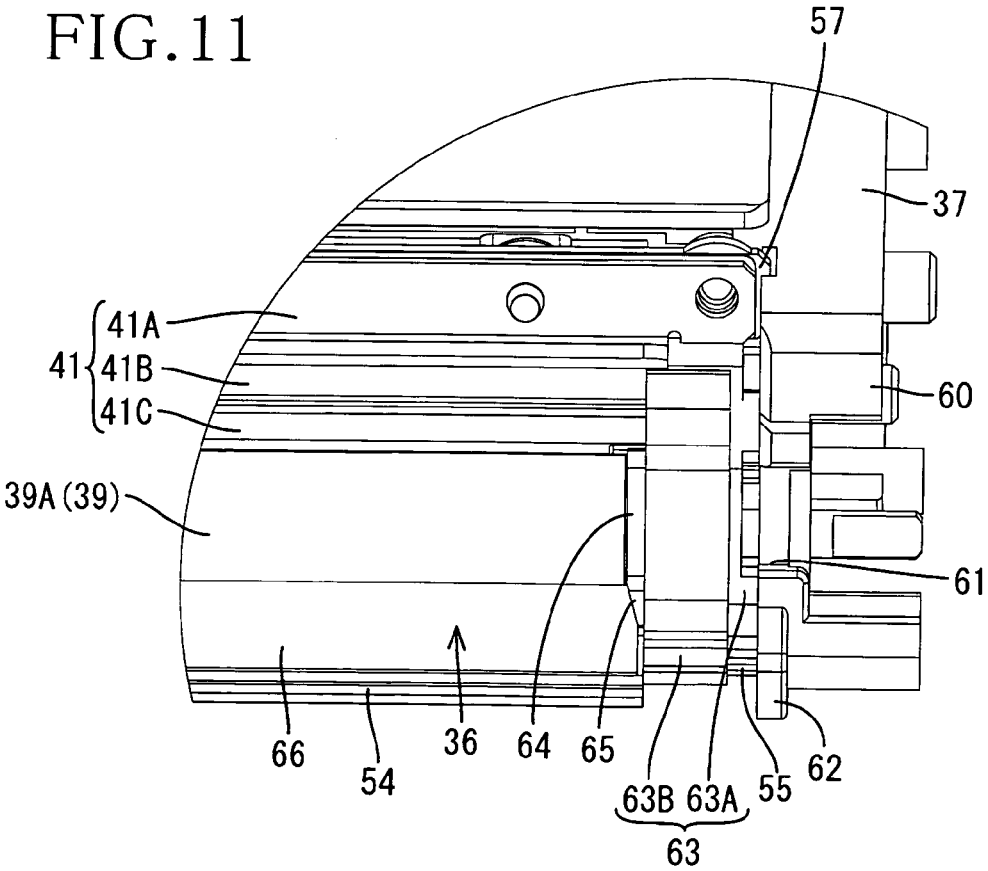
FIG. 11 is a rear view showing the bottom right-side portion of the case where the Teflon® felt has been attached according to illustrative aspects of the invention.
Figure 12:
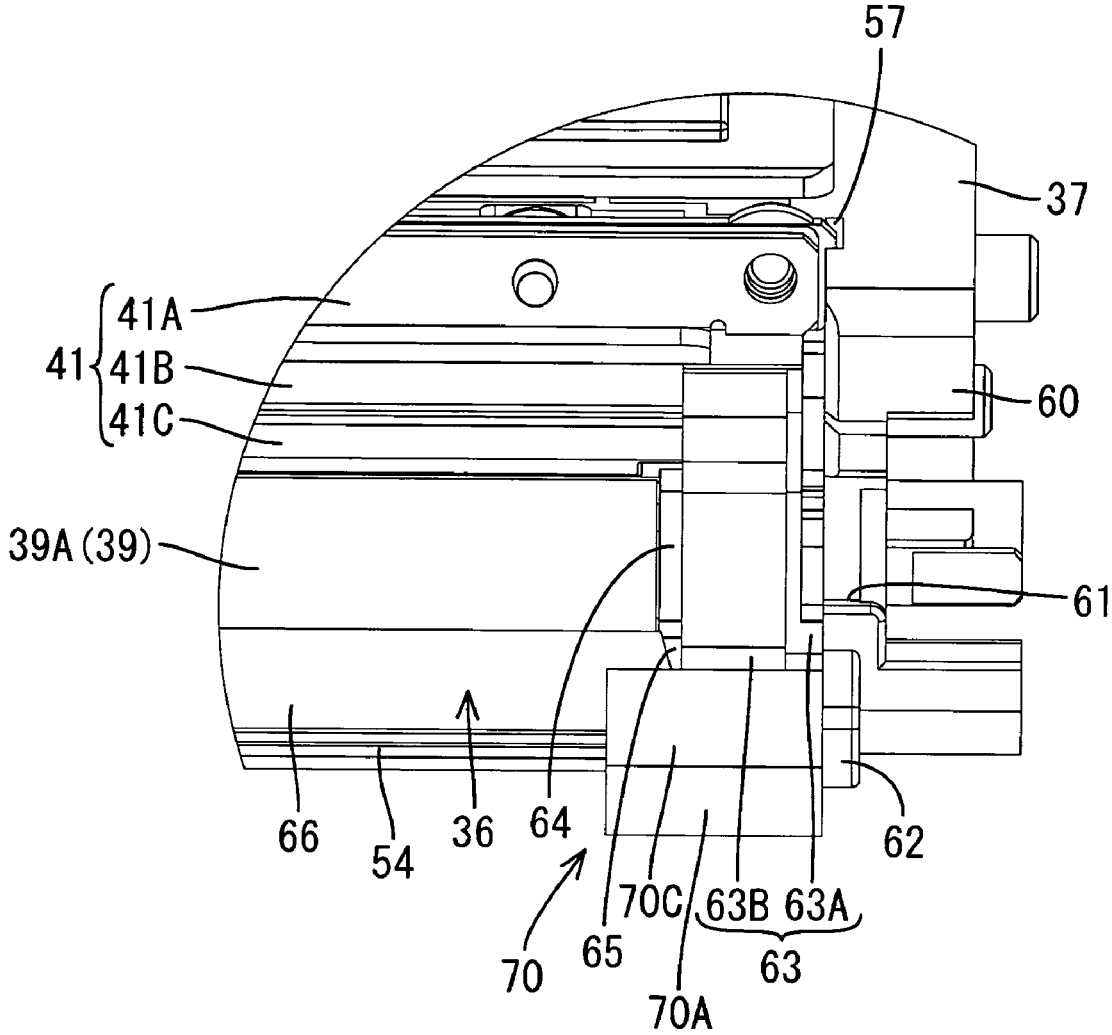
FIG. 12 is a rear view showing the bottom right-side portion of the case where a toner receiving member has been attached according to illustrative aspects of the invention.

As shown in FIGS. 10 and 11, the Teflon® felt 63B is attached using double-faced adhesive tape to cover the end portion of the upper seal 67, the side seal 63A, and the lower edge portion of the side seal attaching portion 55. The Teflon® felt 63B, as a sliding contact portion of the side seal member 63, makes a sliding contact with the circumferential surface of the developing roller 40 at each end thereof along the circumferential direction.

As shown in FIGS. 4, 6, and 12, the toner receiving member 70, as a developing agent receiving member, is attached to the extension portion 62 that projects from the sidewall portion 60 of the case 37, with double-faced adhesive tape. The toner receiving member 70 is formed of a synthetic resin such as ABS resin. The toner receiving member 70 has an open-top box shape, which is open diagonally upward to the front, to be precise, and includes a bottom surface 70A and four sidewalls of a front wall 70B, a rear wall 70C, a right wall 70D, and a left wall 70E. A sponge material 72 capable of absorbing toner is tightly fitted in the toner receiving member 70.

The toner receiving member 70 is provided so as to be open upward below a lower end A (FIG. 4) of the sliding contact surface of the side seal member 63 against the developing roller 40 in a direction relative to gravity (G1). With this arrangement, the toner receiving member 70 is capable of receiving and storing toner leaking from the lower end A of the sliding contact surface. In addition, the toner receiving member 70 is attached so that an upper end of the front wall 70B is continuous with a lower end of the side seal attaching portion 55 (the lower end of the Teflon® felt 63B). Thus, if toner leaks down the Teflon® felt 63B, the toner receiving member 70 can receive the toner. In addition, the rear wall 70C of the toner receiving member 70 is disposed below the developing roller 40 and the upper end of the rear wall 70C extends upward higher than the lower end of the developing roller 40. In terms of a lateral direction, the toner receiving member 70 is provided over a range from the sidewall portion 60 to beyond the side end portion of the lower opening edge portion 54, as shown in FIG. 12. In other words, the end portion of the lower seal 66 in its longitudinal direction and both ends of the side seal 63A and the Teflon® felt 63B are included within the range. Thus, the toner receiving member 70 is also placed, in a direction relative to gravity (G1), below the end portion of the lower seal 66 in its longitudinal direction, so as to receive toner leaking from the end portion of the lower seal 66 in the longitudinal direction. In addition, when the toner receiving member 70 is mounted in the main body casing 2, it is disposed at the front of the photosensitive drum 31 and the lower end thereof is disposed above the conveyor belt 16. After attachment of the toner receiving member 70 as described above, the developing roller 40 is mounted between both sidewall portions 60.

When the process cartridge 23 is placed on a horizontal surface such as a desktop after being removed from the main body casing 2 for replacement, it is placed with a flat surface 37A of the case 37 of the developing cartridge 34 facedown. Similarly, when the developing cartridge 34 is removed from the cartridge frame 30 and placed on the horizontal surface alone, it is placed with the flat surface 37A of the case 37 facedown. In FIGS. 3 and 4, an arrow line G2 indicates a direction relative to gravity (a downward direction) when the developing cartridge 34 is placed on the horizontal surface. The developing cartridge 34 is placed in a position rotated approximately 70 degrees in the clockwise direction in both FIGS. 3 and 4 from a position where the developing cartridge 34 is mounted in the main body casing 2. At this time, the front wall 70B, which is to be a bottom surface of the toner receiving member 70 when the developing cartridge 34 is placed on the horizontal surface, has a rising gradient toward the opening side of the toner receiving member 70. As a result, when toner is stored in the toner receiving member 70, the toner is prevented from leaking outside of the toner receiving member 70, so that the toner is also prevented from leaking from the case 37.

Toner is likely to leak, especially from the lower end A of the sliding contact surface between the side seal member 63 and the developing roller 40. However, according to the above aspects, as the toner receiving member 70, which is formed in an open-top box (container) shape, is provided below the lower end A in the direction of gravity (G1), it can reliably receive and store leaking toner therein, thus preventing toner from leaking to the outside.

In addition, as the toner receiving member 70 is provided so as to be open from below upward in a direction relative to gravity (G1), at each end of the lower seal 66 in its longitudinal direction, it can reliably receive and store toner leaking from the end portion of the lower seal 66 therein.

When the developing cartridge 34 is removed from the main body casing 2 and placed on a horizontal surface such as a desktop, toner stored in the toner receiving member 70 can be prevented from leaking outside the case 37, so that the desktop can be prevented from getting soiled with toner.

In addition, when the developing cartridge 34 is removed from the main body casing 2 and placed on a horizontal surface such as a desktop, the toner stored in the toner receiving member 70 will not leak from the toner receiving member 70. This structure can prevent toner adhesion to components such as the developing roller 40 and the side seal 63A.

In a state where the developing cartridge 34 is placed on a horizontal surface, the front wall 70B, which is to be the bottom surface of the toner receiving member 70, has a rising gradient toward the opening side of the toner receiving member 70. Thus, toner stored in the toner receiving member 70 can be reliably prevented from leaking from the toner receiving member 70.

As the toner receiving member 70 has a box shape, a capacity to store toner can be secured and its exterior shape can be made compact.

The toner receiving member 70 is structured so that the upper end of the rear wall 70C is positioned higher than the lower end of the developing roller 40. Thus, the upper end of the rear wall 70C is extended near the developing roller 40, and a greater depth of the toner receiving member 70 is obtained. Even if the developing cartridge 34 is greatly shaken in the event of a replacement for example, toner in the toner receiving member 70 is unlikely to leak.

As the sponge material 72, which is capable of absorbing toner, is fitted in the toner receiving member 70, toner stored in the toner receiving member 70 may be prevented from leaking.

As the developing cartridge 34, which is detachably attachable to the main body casing 2 of the laser printer 1, is provided with the toner receiving member 70, the developing cartridge 34 can prevent problems due to toner leakage, such as toner stain on the inside of the apparatus or on an operator's fingers or clothing during cartridge replacement.

In addition, as the toner receiving member 70 is disposed between the developing roller 40 and the conveyor belt 16, wasted space may be avoided, thus making the laser printer 1 compact.

In the laser printer 1 that forms color images by a so-called tandem method where developing cartridges 34 are arranged along the conveyor belt 16 to make the printer compact, toner can be prevented from leaking from each developing cartridge 34.

Figure 13:
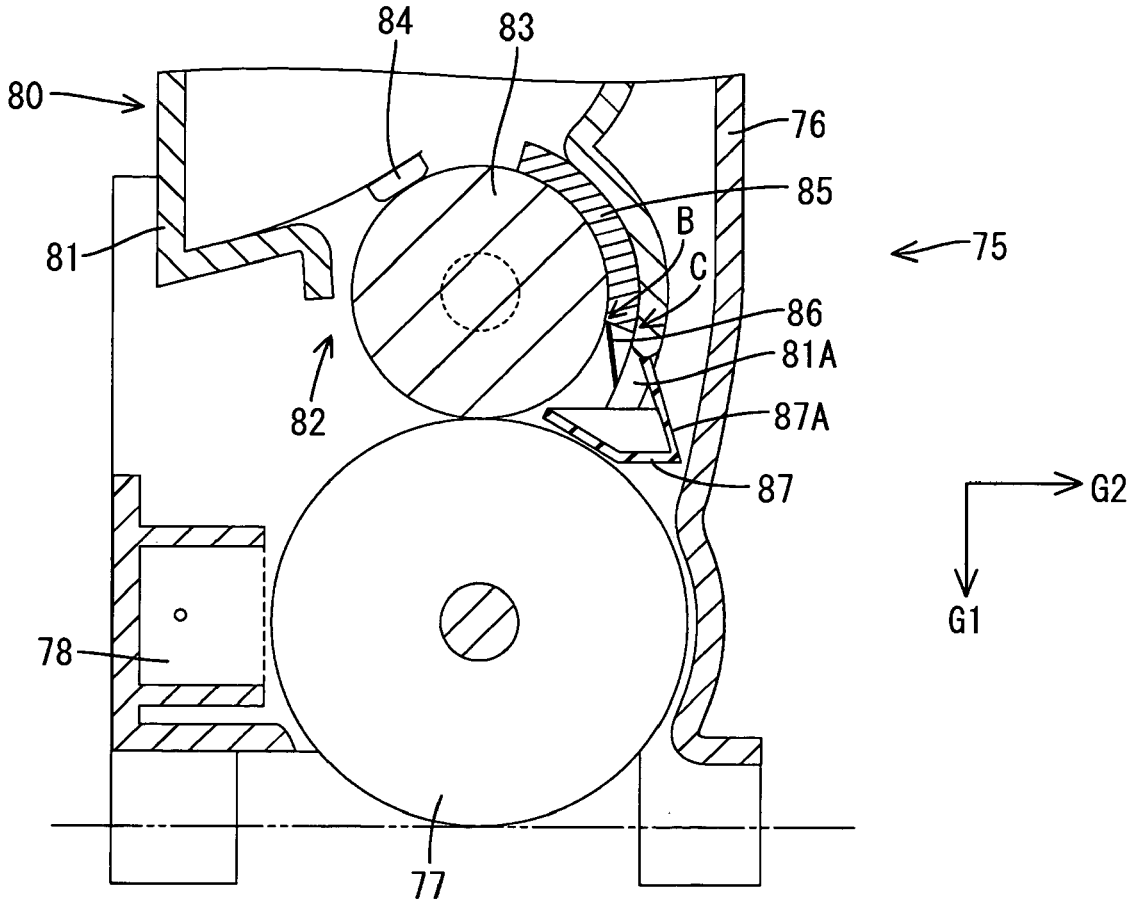
FIG. 13 is a side sectional view showing a bottom end portion of a process cartridge according to according to illustrative aspects of the invention.

Additional aspects of the invention will be described with reference to FIG. 13. FIG. 13 is a side sectional enlarged view of a bottom end portion of a process cartridge 75. In this figure, an arrow line G1 indicates a direction relative to gravity (downward) in a state where the process cartridge 75 is mounted in the main body casing 2 of the laser printer 1, and an arrow line G2 indicates a direction relative to gravity (a downward direction) in a state where the process cartridge 75 or a developing cartridge 80 is placed on a horizontal surface.

The process cartridge 75 includes a photosensitive drum 77 and a scorotron charger 78 in a lower portion of a cartridge frame 76 and the developing cartridge 80 (functioning as a cartridge) in an upper portion thereof. The developing cartridge 80 includes a developing roller 83 inside an opening 82 provided by a lower end of a case 81. The photosensitive drum 77 is disposed directly below the developing roller 83 to face each other. Around the developing roller 83, there are provided a layer thickness regulating blade 84, a side seal member 85, and a lower seal 86. The side seal member 85 is attached to each end of the opening 82 and makes a sliding contact with a circumferential surface of the developing roller 83 at each end. The lower seal 86 is attached to an opening edge portion 81A in a lower portion of the case 81 and makes a sliding contact with the circumferential surface of the developing roller 83.

The case 81 includes a toner receiving member 87, which functions as a developing agent receiving member, outside each end of the opening edge portion 81A in its longitudinal direction. The toner receiving member 87 is shaped like an upward opening container. A lower end portion of the side seal member 85 projects diagonally downward from a lower end B of a sliding contact surface against the developing roller 83. The toner receiving member 87 is disposed so as to be open upward between and beyond a position vertically below the lower end B of the sliding contact surface and a position vertically below a lower end C of the side seal member 85.

When the process cartridge 75 or the developing cartridge 80 only is placed on a horizontal surface such as a desktop, the developing cartridge 80 is placed in a position rotated about 90 degrees in the clockwise direction in FIG. 13 from a position where the developing cartridge 80 is mounted in the main body casing (not shown). When the developing cartridge 80 is placed on the horizontal surface, a front wall 87A of the toner receiving member 87 is placed to a bottom surface side, and has a rising gradient toward the opening side of the toner receiving member 87. As a result, when toner is stored in the toner receiving member 87, the toner is prevented from leaking from the toner receiving member 87, so that the toner is also prevented from leaking from the case 81.

According to these aspects, the toner receiving member 87 is provided so as to be open upward between the position vertically below the lower end B of the sliding contact surface and the position vertically below the lower end C of the side seal member 85. With this arrangement, even when toner leaks from the lower end B of the sliding surface and flows down the lower end C of the side seal member 85, the toner can be received by the toner receiving member 87 reliably.

The photosensitive drum 77 is disposed below the developing roller 83 to face each other, and the toner receiving member 87 is disposed in an upper portion of the photosensitive drum 77. Thus, there may be no waste of space, and the laser printer 1 can be structured in compact form.

In the above aspects, a developing agent receiving member is provided at each end of the developing roller. However, a single developing agent receiving member may be formed to lie across the developing roller.

Aspects previously described show an example of the invention applied to a direct tandem color laser printer that sequentially transfers images to recording media fed on the belt. However, the invention may apply to a color laser with an intermediate transfer belt or a monochrome laser printer.

Each aspect involves a cartridge structured so that, when the cartridge is placed on a horizontal surface, the bottom surface of the developing agent receiving member has a rising gradient toward the opening side. However, according to the invention, a protrusion may be provided near the opening to prevent the developing agent from leaking.

While the various aspects of the invention have been described in conjunction with the exemplary aspects outlined above, various alternatives, modifications, variations, improvements and/or substantial equivalents, whether known or that are or may be presently unforeseen, may become apparent to those having at least ordinary skill in the art. Accordingly, the exemplary aspects of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A cartridge detachably attachable to a main body of an image forming apparatus, the cartridge comprising:

a case configured to store a developing agent and having an opening;

a developing roller rotatably attached to the inside of the opening in the case and configured to form a visible image by transferring the developing agent to an electrostatic latent image; and a side seal member provided at each end of the case, the side seal member having a contact surface that makes contact with a surface of the developing roller, and wherein the case includes a developing agent receiving member, the developing agent receiving member opening below the contact surface in an upward direction and including a first side portion and a second side portion, the first side portion located directly below the contact surface and being continuous with a portion of the side seal member located below the contact surface, and second side portion disposed below the developing roller and extending upward to a position higher than a lower end of the developing roller.

2. The cartridge according to claim 1, wherein the case includes a lower seal provided below the opening, the lower seal configured to make contact with the surface of the developing roller along an axial direction thereof.

3. The cartridge according to claim 1, wherein the developing agent receiving member is configured to prevent the developing agent from leaking outside of the case when the cartridge is placed on a horizontal surface.

4. The cartridge according to claim 3, wherein the developing agent receiving member prevents the developing agent from leaking from the developing agent receiving member when the cartridge is placed on the horizontal surface.

5. The cartridge according to claim 4, wherein the developing agent receiving member has a bottom surface with a rising gradient toward an opening side when the cartridge is placed on the horizontal surface.

6. The cartridge according to claim 1, wherein the developing agent receiving member is shaped like a box opening upward when the cartridge is attached to a main body of an image forming apparatus.

7. The cartridge according to claim 6, wherein the developing agent receiving member is disposed such that an upper end of a sidewall positioned below the developing roller is placed above a lower end of the developing roller when the cartridge is attached to a main body of an image forming apparatus.

8. The cartridge according to claim 1, wherein when the cartridge is attached to a main body of an image forming apparatus, the developing agent receiving member is provided so as to be open upward between a position vertically below the lower portion of the contact surface and a position vertically below a lower portion of the side seal member.

9. The cartridge according to claim 1, wherein the developing agent receiving member includes a sponge material configured to absorb the developing agent.

10. The cartridge according to claim 1, wherein the developing agent receiving member is configured to prevent the developing agent from leaking outside of the case when the cartridge is attached to a main body of an image forming apparatus.

11. An image forming apparatus comprising:

a cartridge detachably attachable to a main body of the image forming apparatus, the cartridge including, a case configured to store a developing agent and having an opening;

a developing roller rotatably attached to the inside of the opening in the case and configured to form a visible image by transferring the developing agent to an electrostatic latent image; and a side seal member provided at each end of the case, the side seal member having a contact surface that makes contact with a surface of the developing roller, and wherein the case includes a developing agent receiving member, the developing agent receiving member opening below the contact surface in an upward direction and including a first side portion and a second side portion, the first side portion located directly below the contact surface and being continuous with a portion of the side seal member located below the contact surface, and second side portion disposed below the developing roller and extending upward to a position higher than a lower end of the developing roller.

12. The image forming apparatus according to claim 11, wherein an image formation belt is disposed below the developing roller, and wherein the lower end of the developing agent receiving member is positioned above the image formation belt when the image formation apparatus is in an intended operating position.

13. The image forming apparatus according to claim 12, wherein a photosensitive drum configured to hold the visible image is disposed below the developing roller and the developing agent receiving member is disposed above an upper portion of the photosensitive drum when the image formation apparatus is in the intended operating position.

14. The image forming apparatus according to claim 12, wherein the image formation belt is configured to hold the visible image.

15. The image forming apparatus according to claim 12, wherein the image formation belt is configured to convey a recording medium.

16. The image forming apparatus according to claim 11, further comprising a plurality of cartridges, each cartridge having a different color developing agent, wherein the plurality of cartridges are arranged along the image formation belt.

17. The image forming apparatus according to claim 12, wherein in the intended operating position, the image formation belt is disposed below the developing roller relative to gravity.

* * * * *

UNITED STATES PATENT AND TRADEMARK OFFICE

CERTIFICATE OF CORRECTION

PATENT NO. : 7,239,824 B2
APPLICATION NO. : 11/232923
DATED : July 3, 2007
INVENTOR(S) : Hiroya Fukuta It is certified that error appears in the above-identified patent and that said Letters Patent is hereby corrected as shown below:

In Claim 1, Column 12, Line 15:
Please replace "and second side" and insert --and the second side--

In Claim 11, Column 13, Line 11:
Please replace "and second side" and insert --and the second side--

Signed and Sealed this

First Day of April, 2008

JON W. DUDAS
*Director of the United States Patent and Trademark Office*